US011771197B2

(12) United States Patent
Ahrens

(10) Patent No.: US 11,771,197 B2
(45) Date of Patent: Oct. 3, 2023

(54) HAIR-SMOOTHING TOOL

(71) Applicant: HAIR4GOOD, LLC., Wilton, CT (US)

(72) Inventor: Mary Deborah Ahrens, Wilton, CT (US)

(73) Assignee: HAIR4GOOD, Wilton, CT (US)

( * ) Notice: Subject to any disclaimer, the term of this patent is extended or adjusted under 35 U.S.C. 154(b) by 303 days.

(21) Appl. No.: 15/944,186

(22) Filed: Apr. 3, 2018

(65) Prior Publication Data

US 2019/0223572 A1 Jul. 25, 2019

Related U.S. Application Data

(60) Provisional application No. 62/622,054, filed on Jan. 25, 2018.

(51) Int. Cl.

| | |
|---|---|
| ***A45D 24/16*** | (2006.01) |
| ***A46B 9/02*** | (2006.01) |
| ***A46B 15/00*** | (2006.01) |
| ***A45D 24/42*** | (2006.01) |
| ***A46B 9/06*** | (2006.01) |

(Continued)

(52) U.S. Cl.

CPC ..... *A45D 24/16* (2013.01); *A45D 24/42* (2013.01); *A46B 9/023* (2013.01); *A46B 9/065* (2013.01); *A46B 15/0059* (2013.01); *A46B 17/06* (2013.01); *A45D 2/2478* (2013.01); *A46B 2200/104* (2013.01)

(58) Field of Classification Search

CPC ..... A46B 2200/104; A46B 2200/1093; A46B 2200/1086; A46B 9/02; A46B 9/005; A46B 9/06; A46B 9/023; A46B 9/021; A46B 15/00; A46B 15/0059; A46B 5/0004; A46B 5/0008; A46B 5/0016; A46B 5/002; A46B 5/0025; A46B 5/0033; A46B 5/0095; A46B 5/0029; A46B 5/023; A45D 24/16; A45D 24/00; A45D 24/04; A45D 24/18; A45D 34/042; A45D 40/262; A45D 44/18; A01K 13/00

USPC ..... 15/104.001, 106, 159.1, 160, 186, 187, 15/207; 119/615, 628, 629, 664

See application file for complete search history.

(56) References Cited

U.S. PATENT DOCUMENTS 3,204,646 A * 9/1965 Chamberlin ..... A45D 2/2478 132/250
3,498,301 A * 3/1970 Zimmerman ..... A45D 2/2478 132/243

(Continued)

FOREIGN PATENT DOCUMENTS

CN 205106728 U 3/2016
EP 0092000 10/1983

(Continued)

*Primary Examiner* — Cris L. Rodriguez
*Assistant Examiner* — Karim Asqiriba
(74) *Attorney, Agent, or Firm* — Seyfarth Shaw

(57) ABSTRACT

A hair-smoothing tool includes a supporting base, a carpeting structure on or over the supporting base, and optionally bristles and a cushion member. The bristles and the cushion member, if present, are formed on a first surface of the supporting base. The hair-smoothing tool further includes a carpeting structure on either the first surface of the supporting base or an opposite second surface of the supporting base, or both. The carpeting structure, for example, may be a hook structure or a loop structure of a Velcro® hook and loop fastener.

2 Claims, 17 Drawing Sheets

(51) Int. Cl.
*A46B 17/06* (2006.01)
*A45D 2/24* (2006.01)

(56) References Cited

U.S. PATENT DOCUMENTS 4,211,217 A * 7/1980 Gueret ..... A46B 3/20 601/137
4,486,915 A * 12/1984 Stewart ..... A46B 9/06 15/187
5,261,426 A 11/1993 Kellett et al.
5,286,949 A * 2/1994 Simons ..... A45D 4/16 126/369
5,819,762 A * 10/1998 Kim ..... A45D 2/12 132/222
5,890,255 A 4/1999 Robinson
6,012,466 A * 1/2000 Apanasewicz ..... A45D 2/2478 132/212
6,092,534 A * 7/2000 Cheung ..... A45D 2/362 132/212
6,112,362 A * 9/2000 Parko ..... A46B 17/06 132/119
D439,373 S * 3/2001 Cheung ..... D28/37
D469,924 S * 2/2003 Farrell ..... D28/37
6,901,622 B2 * 6/2005 Thompson ..... A47L 25/08 15/1.52
8,453,286 B2 * 6/2013 Kenna ..... A46B 9/06 15/160
8,763,616 B2 * 7/2014 Koptis ..... B65D 73/0071 134/93
2004/0006854 A1 * 1/2004 Simon ..... A44B 18/0088 24/306
2006/0236484 A1 * 10/2006 Lee ..... A46D 1/00 15/167.1
2006/0272115 A1 * 12/2006 Kacher ..... A47L 13/18 15/208
2006/0288512 A1 * 12/2006 Kinchen ..... A46B 17/06 15/246
2006/0288600 A1 * 12/2006 Taylor ..... D06F 58/203 34/60
2009/0188062 A1 * 7/2009 Chudzik ..... A46B 7/00 15/143.1
2011/0107559 A1 * 5/2011 Caveney ..... F16L 3/233 24/16 R
2012/0311800 A1 * 12/2012 Lew ..... A47L 25/00 15/160
2015/0216292 A1 * 8/2015 Tweel ..... A46B 9/06 15/160
2015/0250271 A1 * 9/2015 Ogilvie ..... A44B 18/00 24/444
2016/0157593 A1 6/2016 Sze
2017/0231380 A1 * 8/2017 Yang ..... B25G 1/06 132/121
2017/0290291 A1 * 10/2017 Moeller ..... A01K 13/002
2018/0014611 A1 1/2018 Kaiko
2018/0020820 A1 * 1/2018 Crone ..... A46B 5/0095 15/1.52
2018/0199688 A1 * 7/2018 Powell ..... A46B 17/06

FOREIGN PATENT DOCUMENTS

JP 57171729 U 10/1982
JP 2000-212245 A 7/2000
JP 2010213730 A 9/2010
JP 2016154750 A 9/2016
WO 2013178977 5/2013

* cited by examiner

HAIR-SMOOTHING TOOL

CROSS-REFERENCE TO RELATED APPLICATIONS

The present application is a non-provisional application claiming benefit from a U.S. Provisional Patent Application bearing a Ser. No. 62/622,054 and filed Jan. 25, 2018, contents of which are incorporated herein for reference.

FIELD OF THE INVENTION

The present invention relates to a hair-smoothing tool, e.g. a comb or a brush, and more particularly to a hair-smoothing tool which includes a carpeting structure for untangling and shining hair.

BACKGROUND OF THE INVENTION

A variety of combs and brushes for smoothing hair have been commercially available. In spite a comb and a brush are different in shapes and manufactured in different ways, both of them are common in having a supporting base and a plurality of projections, e.g. teeth or bristles, protruding from the supporting base. In general, the teeth of a comb are integrally formed with the supporting base with the same material. On the other hand, the bristles of a brush may be integrally formed with the supporting base, secured onto the supporting base, or removably mounted onto the supporting base. For different purposes, special comb or brush designs have also been developed to enhance hair-smoothing effects or for additional functions. Taking brushes as examples, a cushion brush as exemplified in FIG. 1A or a paddle brush as exemplified in FIG. 1B has a supporting base 11 and a plurality of bristles 12 protruding from the supporting base 11. The bristles 12 may be integrally formed with the supporting base 11 or attached onto the supporting base 11. For example, the bristles 12 penetrates through and are lodged in holes of a cushion member 13, and the cushion member 13 engages with the supporting base 11 at a surface 111 of the supporting base 11. The cushion member 13 may be assembled to the supporting base 11, for example, by snapping or simply gluing.

In a snapping process, the border of the cushion member 13 is secured onto the supporting base 11 with a snapping member 14, as illustrated in FIG. 2.

Alternatively, the border of the cushion member 13 is deformably inserted into a cyclic groove 110 of the supporting base 11 and then automatically restores to its initial configuration to be engaged in the groove, thereby securing the cushion member 13 onto the supporting base 11, as illustrated in FIG. 3.

Bristles of conventional brushes are generally made of metallic material or plastic material. While metallic bristles might hurt user's scalp, plastic bristles likely suffer from electrostatic charges, which make hair uneasy to be smoothed. On the other hand, conventional combs generally suffer from unsatisfactory hair-smoothing effects due to sparse teeth.

SUMMARY OF THE INVENTION

Therefore, it is desirable to develop a hair-smoothing tool, which can smooth hair while comforting scalp.

The present invention provides a hair-smoothing tool, which comprises: a supporting base to be held by a user to move over hair; and a carpeting structure at least partially overlying the supporting base, and including a plurality of mini-posts, which stick out of the supporting base for penetrating hair when the supporting base moves over hair. The mini-posts, for example, are loop posts and/or hook posts.

The present invention further provides a hair-smoothing tool, which comprises: a supporting base to be held by a user to move over hair; a plurality of bristles sticking out of the supporting base, and penetrating hair when the supporting base moves over hair; and a carpeting structure including a plurality of mini-posts, which at least partially overly the supporting base and/or the bristles and penetrate hair when the supporting base moves over hair.

Preferably, the mini-posts, e.g. the loop posts and/or the hook posts, are made of a soft material that would not hurt hair and scalp but rigid enough to detangle hair and smooth hair.

BRIEF DESCRIPTION OF THE DRAWINGS

The above contents of the present invention will become more readily apparent to those ordinarily skilled in the art after reviewing the following detailed description and accompanying drawings, in which:

FIG. 7 is a schematic diagram illustrating a detangling brush where a carpeting structure according to the present invention can be use with;

FIG. 8 is a schematic diagram illustrating a metal thermal round brush where a carpeting structure according to the present invention can be use with;

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1A:
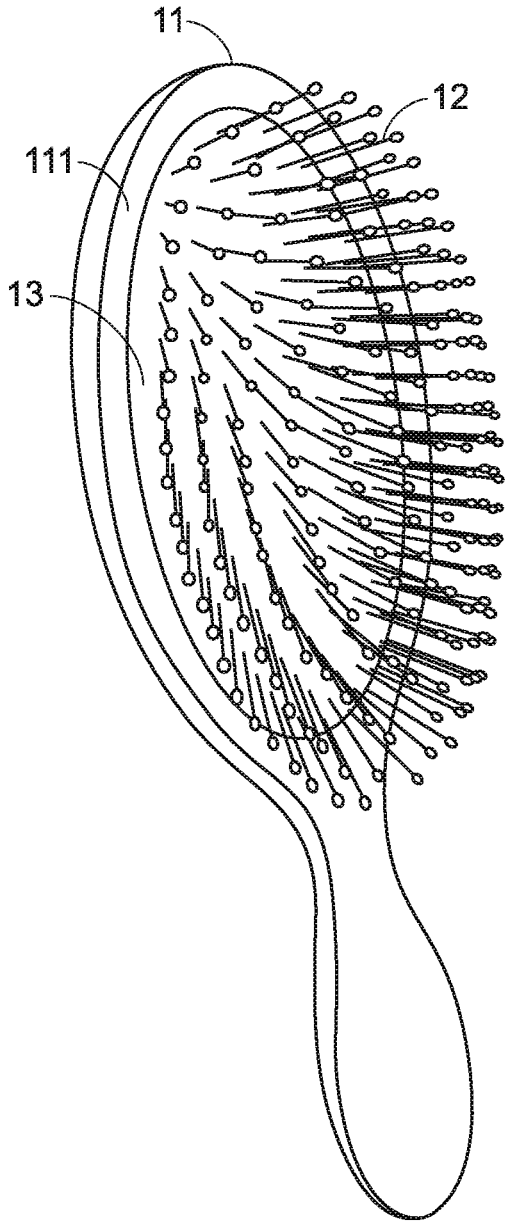
FIG.1A PRIOR ART
FIG. 1A and FIG. 1B are schematic diagrams illustrating conventional hair brushes.
Figure 1B:
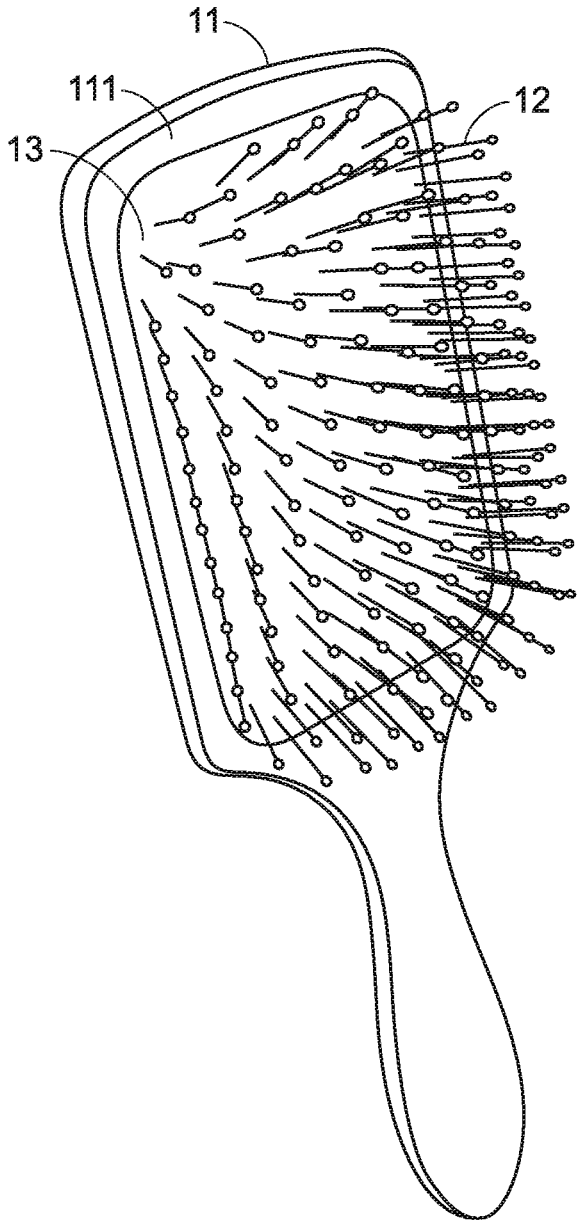
FIG.1B PRIOR ART

A hair-smoothing tool according to the present invention may be configured as, for example, a comb, a brush, or any other suitable structure for smoothing hair. According to an embodiment of the present invention, the hair-smoothing tool includes a supporting base 11, bristles 12 and a cushion member 13 similar to those generally included in a conventional hair brush, for example, as illustrated in FIG. 1A or 1B. The bristles 12 and the cushion member 13 are formed on a first surface 111 of the supporting base 11. The hair-smoothing tool further includes a carpeting structure 15 on either the first surface 111 of the supporting base 11 (FIG. 4A, 4B) or an opposite second surface 112 of the supporting base 11 (FIG. 4C), or both.

Figure 2:
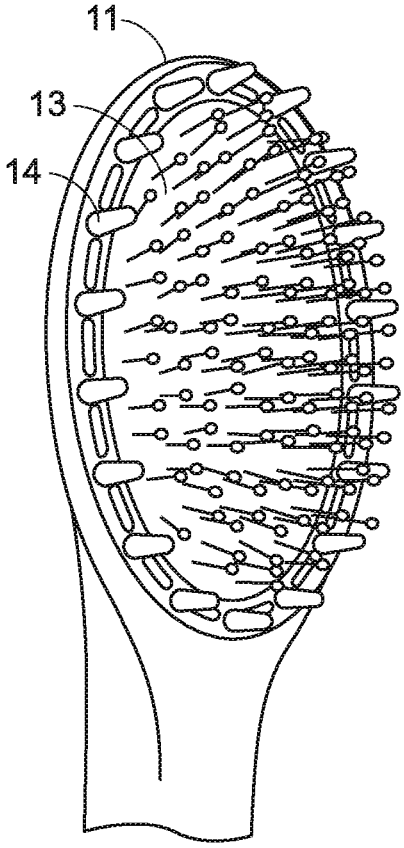
FIG.2 PRIOR ART
FIG. 2 is a schematic diagram illustrating a hair brush with a cushion member snapped onto a supporting base.
Figure 3:
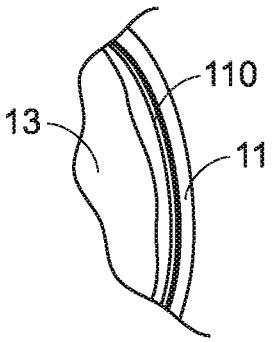
FIG. 3 is a schematic diagram illustrating a partially enlarged view of a hair brush with a border of a cushion member inserted into a cyclic groove of a supporting base.
Figure 4A:
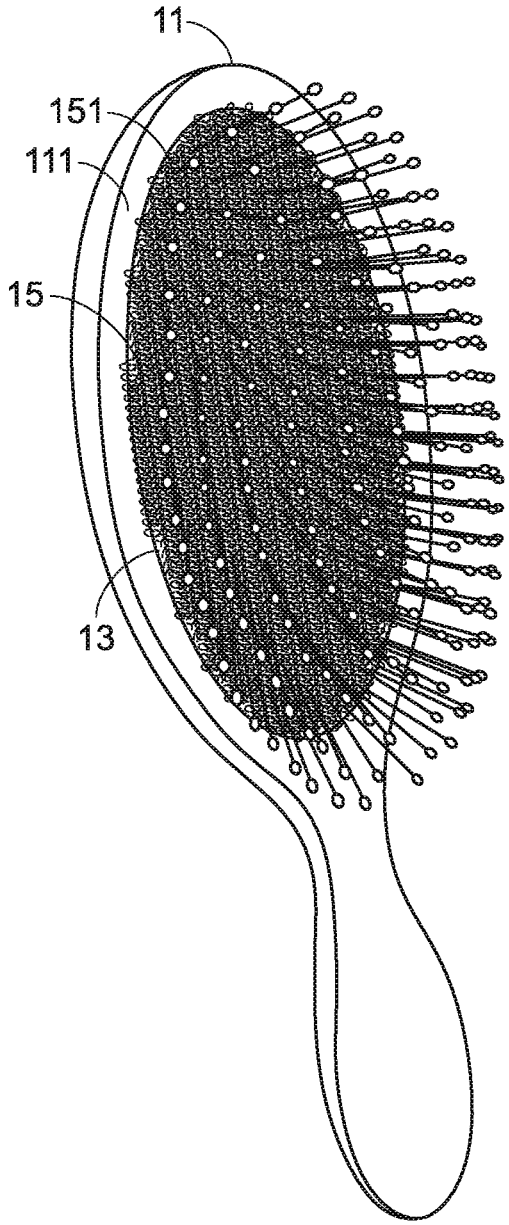
FIG. 4A is a schematic diagram illustrating a hair-smoothing tool according to an embodiment of the present invention.

In the embodiment as illustrated in FIG. 4A, the bristles 12 are formed or assembled to the cushion member 13, and the cushion member 13 is provided on the supporting base 11 by way of any proper engaging or adhering means. For example, a snapping process as illustrated above with reference to FIG. 2 or 3 can be used for engaging the cushion member 13 with the supporting base 11. Of course, the cushion member 13 could be simply glued onto the supporting base 11. No matter how the cushion member 13 is attached onto the supporting base 11, it is optional but preferable that the cushion member 13 is made of a material and there exists buffering means between the cushion member 13 and the supporting base 11 for better tactile feeling and closer contact with hair. The buffering means may be an air gap. Alternatively, a resilient material, e.g. a sponge or a rubber piece, may be used as the buffering means to achieve the object of floating the cushion member. Alternatively, the cushion member 13 itself may have a buffering effect contributed to specifically designed material, thickness and/or configuration, and may be directly glued onto the supporting base 11.

Figure 4B:
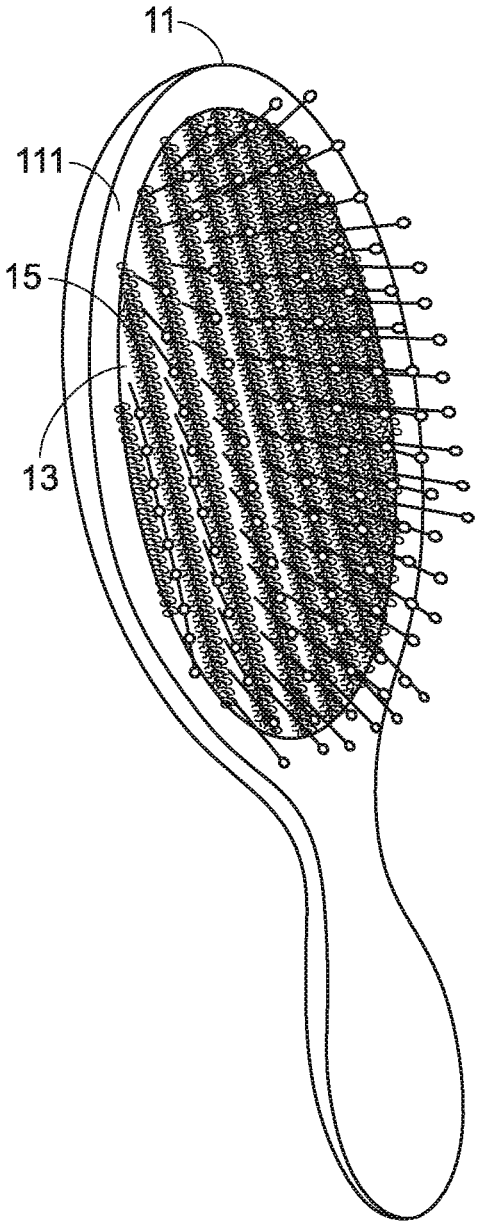
FIG. 4B is a schematic diagram illustrating a hair-smoothing tool according to another embodiment of the present invention.

The carpeting structure 15, in an embodiment, is a planar sheet and may be secured onto the supporting base 11 together with the cushion member 13, for example, in the same snapping process. For example, the carpeting structure 15 has a plurality of holes 151 for the bristles 12 on the cushion member 13 to penetrate through, thereby combining the carpeting structure 15 and the cushion member 13 together. Then, a border of the carpeting structure 15 may be snapped onto the supporting base 11, inserted into a groove of the supporting base 11, or glued to the supporting base 11 together with the cushion member 13. In another embodiment, the carpeting structure 15 consists of a plurality of carpeting strips 15, which are allocated between adjacent rows and/or columns of the bristles 12, as illustrated in FIG. 4B. In spite rows and/or columns of carpeting strips are exemplified in this embodiment to consist the carpeting structure, the carpeting structure may also be configured as or divided into a plurality of of small portions, which are arranged into a specific pattern, e.g. cross lines, concentric circles, swirls or waving, and so on, or provided at specified positions varying with the distribution of the bristles.

Figure 4C:
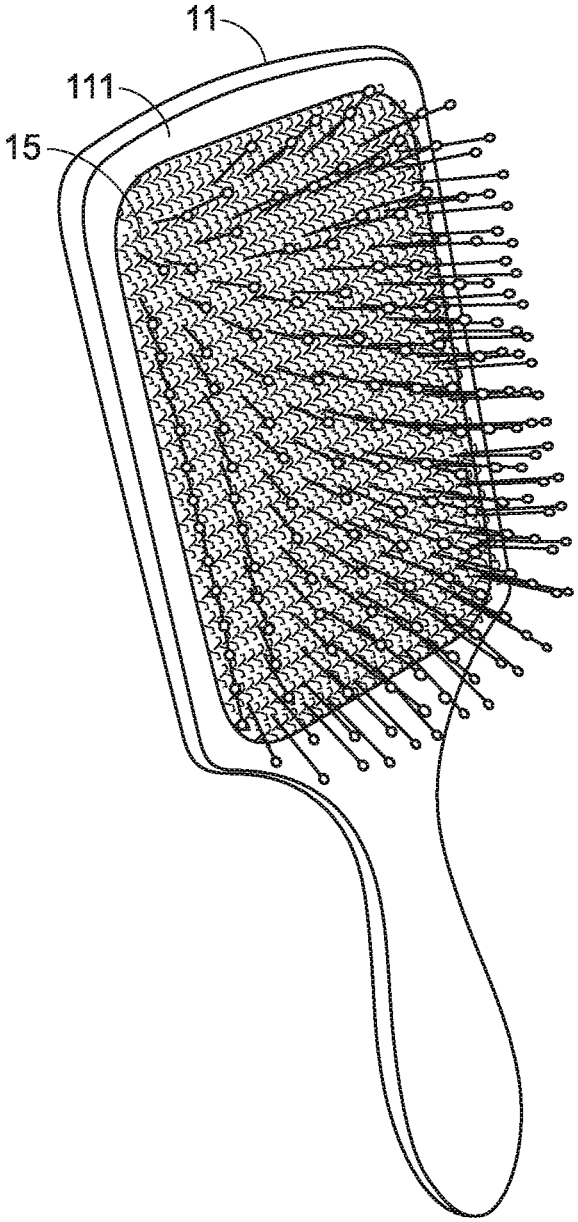
FIG. 4C is a schematic diagram illustrating a hair-smoothing tool according to a further embodiment of the present invention.

Alternatively, the cushion member 13 may be omitted and the bristles 12 are integrally formed with the supporting base 11, as illustrated in FIG. 4C. In this embodiment, the carpeting structure 15 may be directly integrated with the supporting base 11. Alternatively, the carpeting structure 15 may be integrated with a flexible base 150, which has the plurality of holes 151 and secured onto the supporting base 11 by having the bristles 12 penetrate through the holes. The carpeting structure 15 may be secured onto the supporting base 11, for example, by way of glue or any other suitable means which will be described later. The flexible base 150 may be a flat piece of material which is contiguous with the supporting base 11 after assembling. Alternatively, the flexible base 150 may be a convex piece of material which is a specified distance above the supporting base 11 in the middle after assembling so as to provide a cushion effect.

In the above embodiments, the carpeting structure 15 is a loop structure consisting of a number of tiny loop posts (FIG. 4A) or a hook structure consisting of a number of tiny hook posts (FIG. 4C), e.g., loop posts and hook posts of a Velcro® hook and loop fastener, optionally on a flexible base 150. By the nature of the loop structure and the hook structure, hair cuticles can be further smoothed and fizz can be eliminated when the loop structure or hook structure penetrates hair. Meanwhile, hair becomes shinier after being combed with the dense mini-loop or hook structures. Therefore, bristles made of a relatively soft material and/or having a reduced number may be used. Although a Velcro® hook and loop fastener is used as an example, other similar structures or other mini-structures having similar smoothing performance may alternatively be used as the carpeting structure of the hair-smoothing tool according to the present invention. Furthermore, by selecting a proper material and adjusting softness of the carpeting structure 15, the carpeting structure can further perform a massage function on the scalp while combing hair.

Figure 4D:
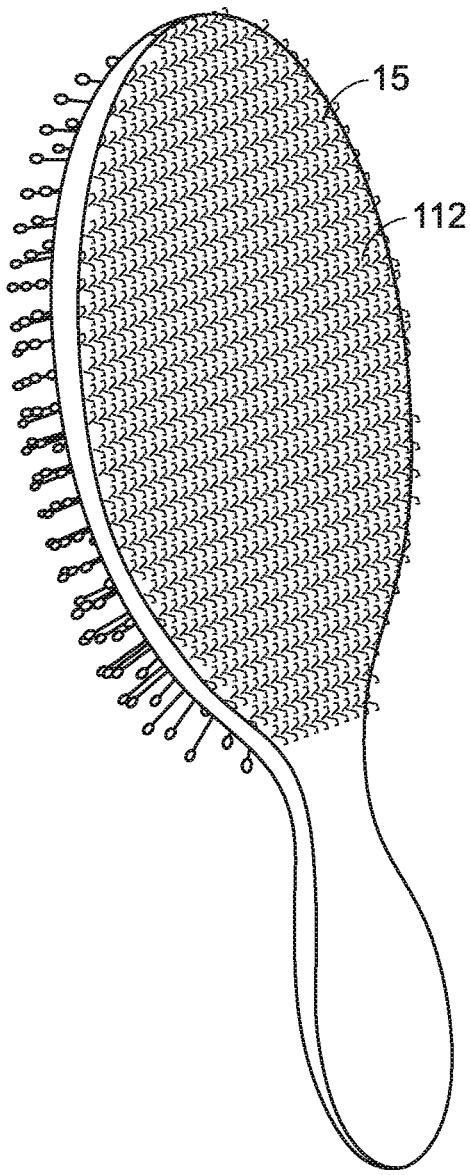
FIG. 4D is a schematic diagram illustrating a hair-smoothing tool according to a still further embodiment of the present invention.

In another embodiment, the carpeting structure 15 is applied to the supporting base 11 and partially overlies a surface of the supporting base 11, where no bristles are indicated. More specifically, the bristles 12 are distributed on a first portion of the supporting base 11, and the carpeting structure 15 is provided on a second portion of the supporting base 11. The carpeting structure 15 includes a plurality of loop posts and/or hook posts, which stick out of the supporting base for penetrating hair when the supporting base moves over hair. Taking a paddle brush shown FIG. 4D as an example, the bristles 12 are provided on the first portion, e.g. the first surface 111, and the carpeting structure 15 are provided on the second portion, e.g. the second surface 112, and they, individually, can be used or not used depending on desired results. Alternatively, the carpeting structure 15 can be applied to both the first surface 111 with bristles 12 and the second surface 112 without bristles.

Figure 5:
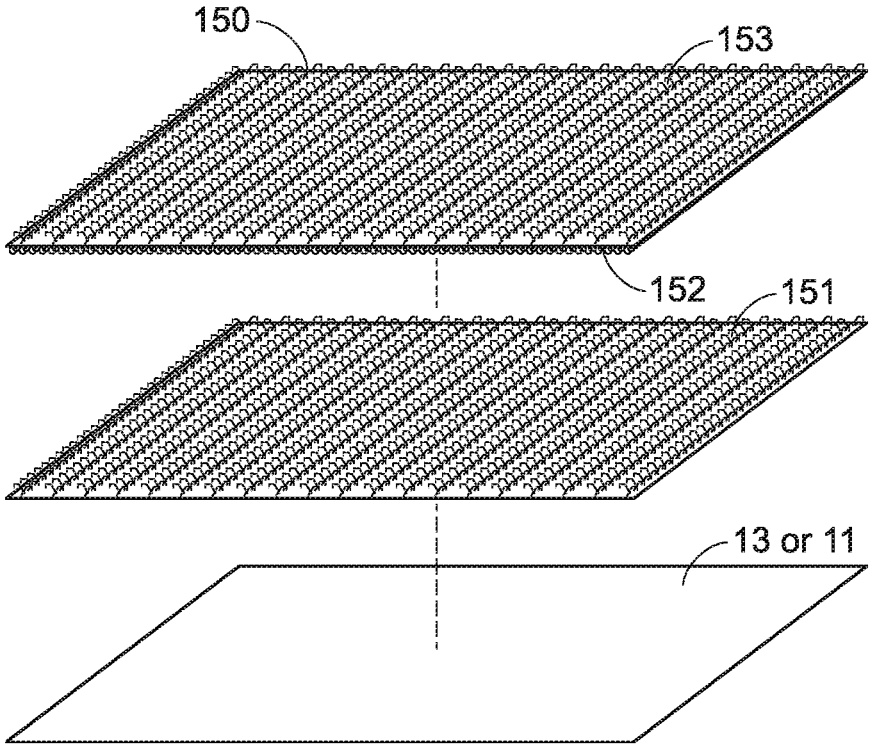
FIG. 5 is a schematic diagram illustrating an example of a carpeting structure used in a hair-smoothing tool according to the present invention.

In alternative embodiments, the carpeting structure 15 has a multi-layer structure consisting of multiple hook-structured/loop-structured layers. For example, as shown in FIG. 5, the carpeting structure 15 includes a hook-structured layer 151, a loop-structured layer 152 overlying the hook-structured layer 151, and another hook and/or loop structure 153 overlying the loop-structured layer 152, wherein the loop-structured layer 152 and the hook and/or loop structure 153 are formed on opposite surfaces of a flexible base 150. The hook-structured layer 151 is integrated with the cushion member 13, or the supporting base 11 (if the cushion member 13 is omitted), or it is glued to or engaged with the supporting base 11 or the cushion member 13 by way of another flexible base 150 in a manner described above. The loop-structured layer 152 faces the hook-structured layer 151 so that the flexible base 150 is attachable onto and detachable from the hook-structured layer 151, just like a Velcro® hook and loop fastener. The hook and/or loop structure 153 formed of the hook structure, loop structure or both are disposed opposite to the loop-structured layer 152, and functions for smoothing hair, just like the above-described carpeting structure 15. This embodiment is advantageous in conveniently cleaning the brush by easily pulling off the flexible base 150, where hair might be accumulated, for washing or replacing. It is understood that a carpeting structure formed with more than three layers may be used for practical requirements.

Figure 6:
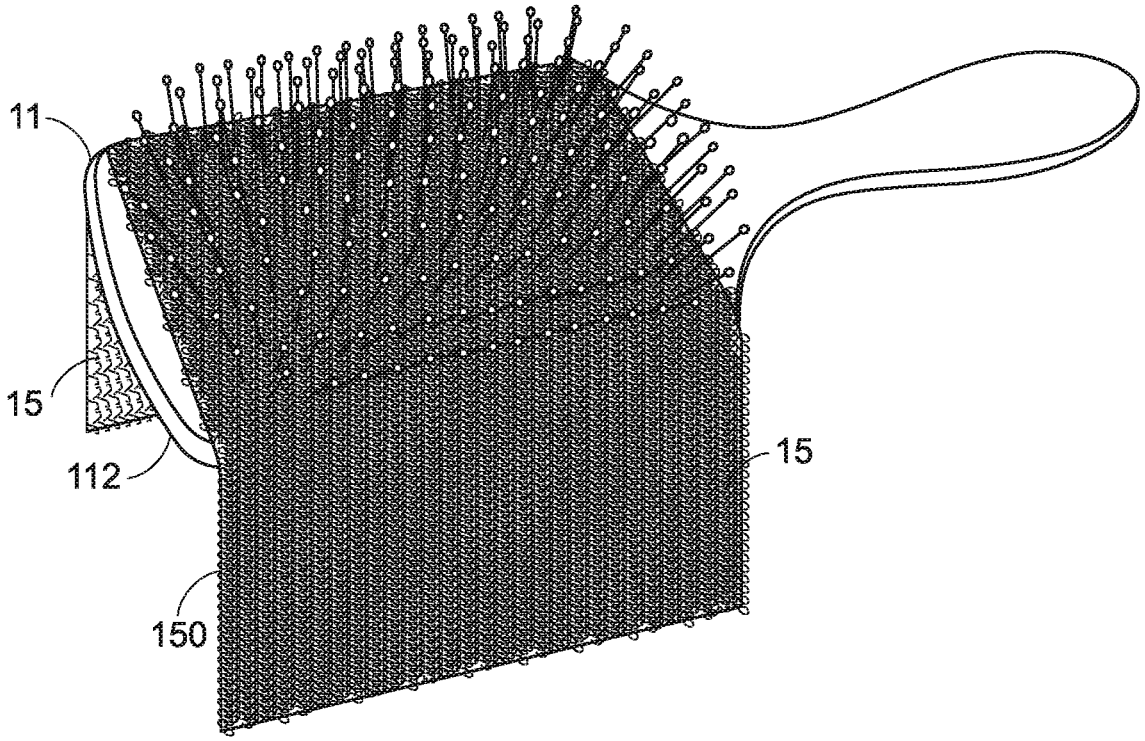
FIG. 6 is a schematic diagram illustrating an assembling example of a carpeting structure to a supporting base of a hair-smoothing tool according to the present invention.

As mentioned above, the carpeting structure 15 may be secured onto the supporting base 11 or the cushion member 13 in a manner other than snapping, floating and gluing. An example is using an extensive carpeting structure including a hook structure and a loop structure disposed at opposite sides of the flexible base 150. When the hook-structured side and the loop-structured side are connected, for example, at the back surface 112 of the supporting base 11, the hook structure and the loop structure will engage with each other to secure the carpeting structure 15, as illustrated in FIG. 6.

Figure 7:
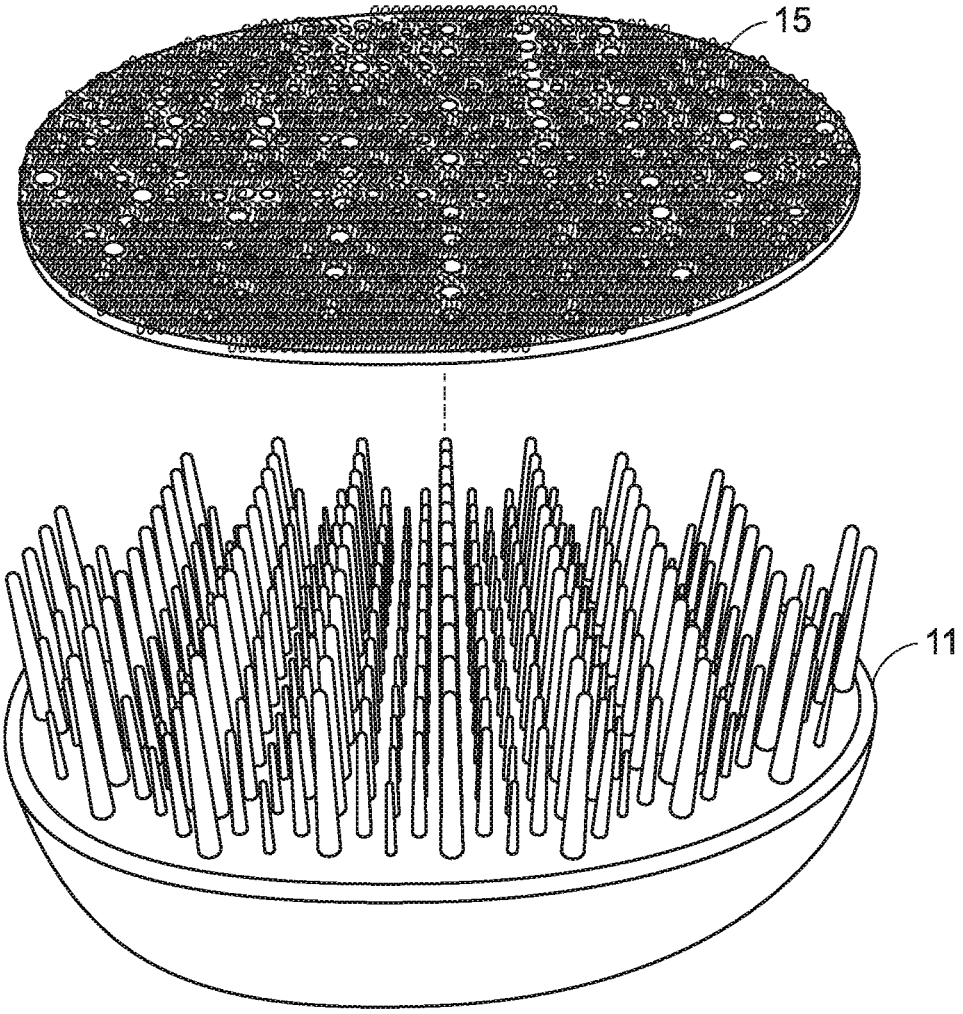
Figure 8:
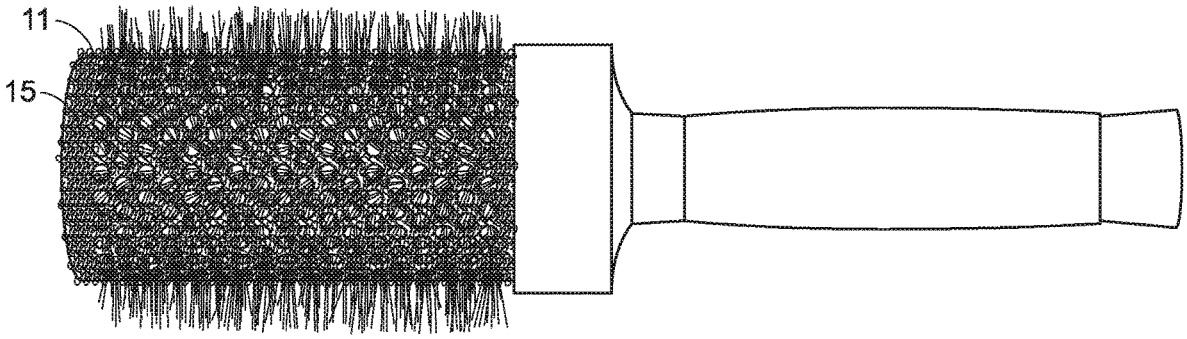
Figure 9A:
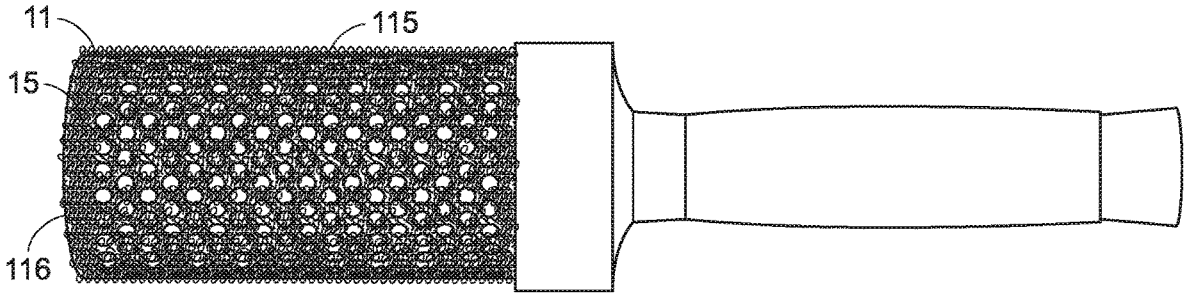
FIG. 9A is a schematic diagram illustrating a hair-smoothing tool according to a still another embodiment of the present invention.
Figure 9B:
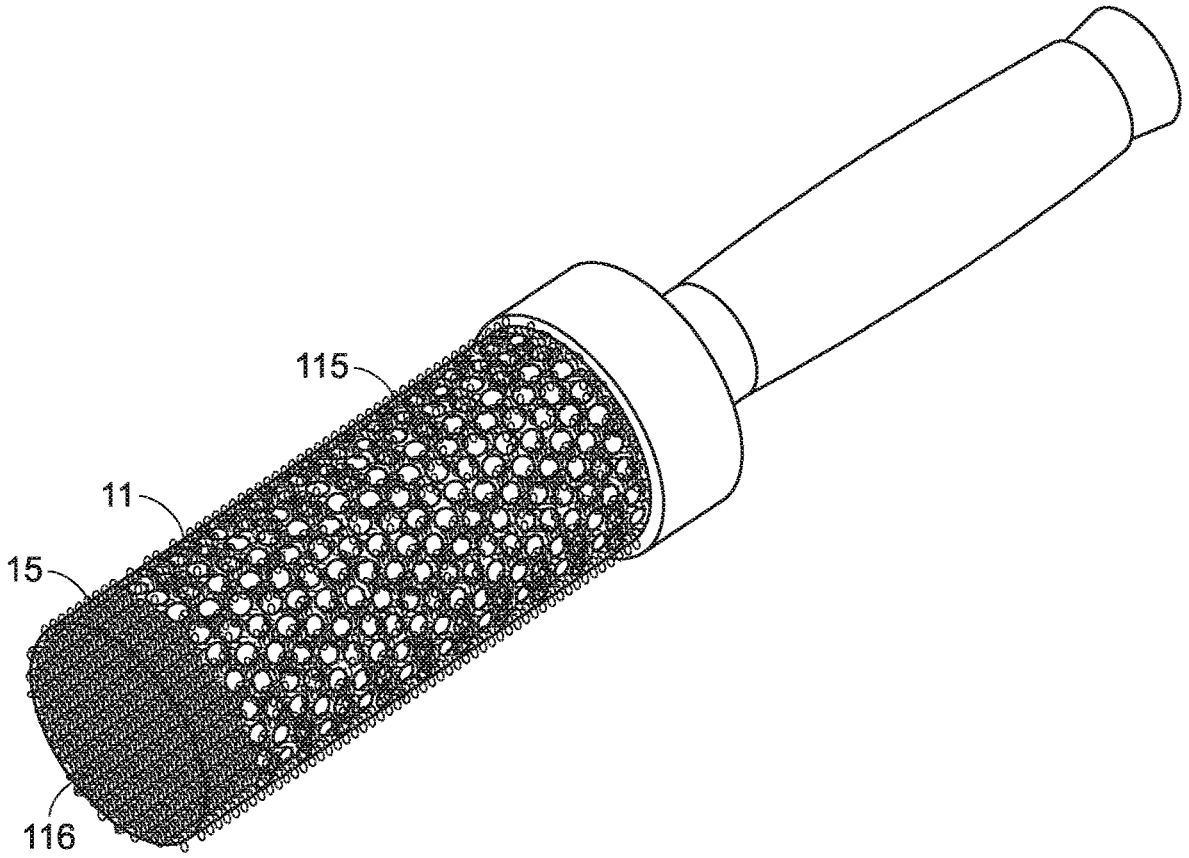
FIG. 9B is a schematic diagram illustrating a hair-smoothing tool according to a still further embodiment of the present invention.

The carpeting structure according to the present invention, as exemplified above, can be applied to any proper hair comb or brush skeleton. For example, the carpeting structure 15 may be applied to a detangling brush as illustrated in FIG. 7, a metal thermal round brush as illustrated in FIG. 8, or a vent brush (not shown). The carpeting structure according to the present invention, as exemplified above, can also be applied to a finishing brush without bristles, as illustrated in FIG. 9A or 9B. In FIG. 9A, the hook/loop structure 15 surrounds the barrel 115 of the supporting base 11. In FIG. 9B, the hook/loop structure 15 is further applied to the top face 116 and/or the bottom face in addition of the supporting base 11 to the circumference of the barrel 115.

Figure 10:
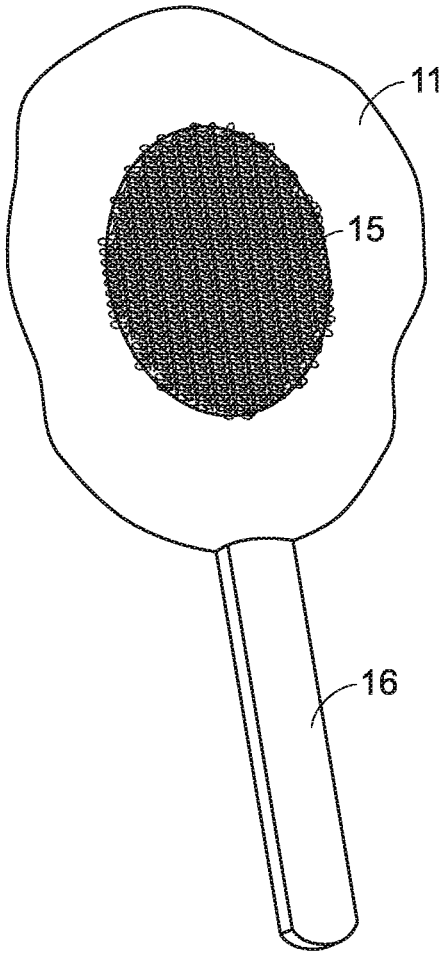
FIG. 10 is a schematic diagram illustrating a hair-smoothing tool according to a still further embodiment of the present invention.

Moreover, the supporting base 11 described above does not have to be hard. Alternatively, the supporting base 11 may be made of a soft material such as rubber, and the carpeting structure 15 can be provided onto the supporting base 11 with or without bristles, for example by integrating with the supporting base 11 via a flexible base 150 in a manner described above. The soft base 11 with the carpeting structure 15 may be attached onto and removed from a proper hard object 16 as illustrated in FIG. 10, e.g. a handle or user's hand, for conducting hair-smoothing operations.

For further improving hair-smoothing performance, particularly for hair styling, it is preferred that the hair-smoothing tool can release heat while the carpeting structure is smoothing hair. For achieving this purpose, the supporting base 11, the cushion member 13, and the carpeting structure 15 may be made of heat-resistant materials, which can be heated to a proper temperature for hair styling without damages, and exhibit heat-retaining, heat-conducting and heat-dissipating capabilities. Ceramic, copper, aluminum, titanium, foil, iron, steel, carbon fiber, fiber glass, ceramic, clay, magnesium and metallic materials are some of the examples of the heat-resistant and heat-conductive materials. The heating means, for example, may be microwave, oven, electricity, steam, sun, induction, or any other suitable heating source.

Figure 11A:
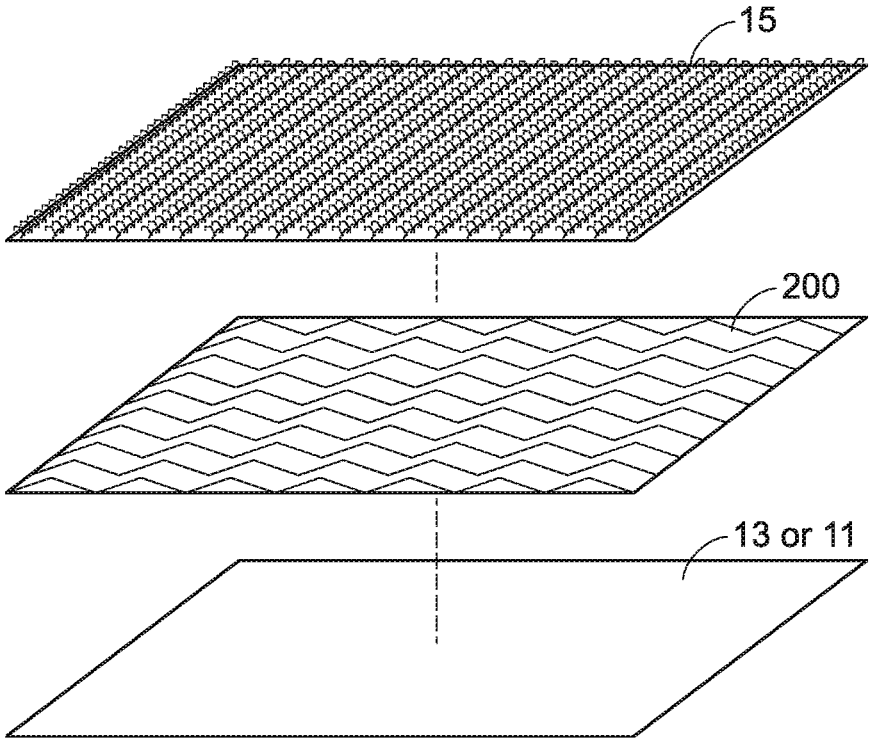
FIG. 11A and FIG. 11B are schematic diagrams illustrating examples of heating members used in a hair-smoothing tool according to a still further embodiment of the present invention.
Figure 11B:
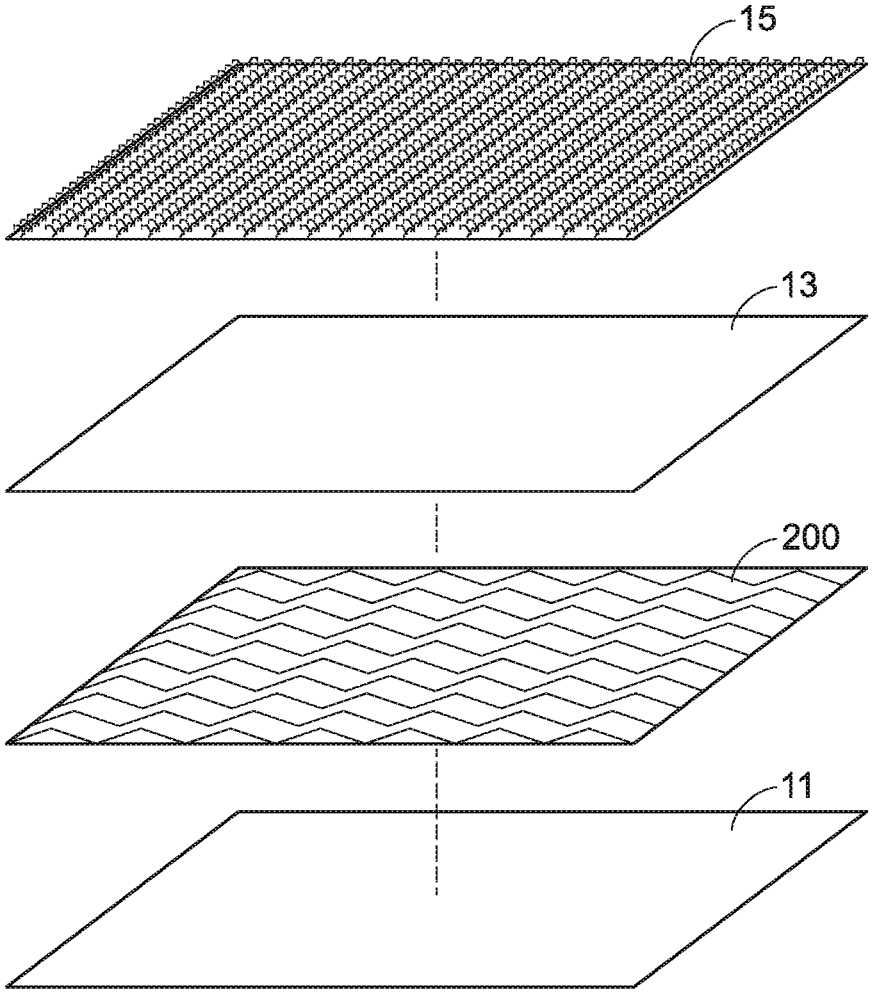

Alternatively, a heater material 200, which can spontaneously dissipate heat and/or be heated after being placed in the hair-smoothing tool, may be additionally used for enhancing the heating efficiency, as illustrated in FIG. 11A and FIG. 11B. In the embodiment shown in FIG. 11A, the heater material 200 is disposed between the carpeting structure 15 and the supporting base 11, or the cushion member 13, if any. In the embodiment shown in FIG. 11B, the heater material 200 is disposed between the cushion member 13 and the supporting base 11. Preferably, the heater material 200 has a higher specific heat capacity than other parts of the hair-smoothing tool, which might be in direct contact with the scalp of the user, so that the heater material 200 may be heated to a temperature higher than the other parts of the hair-smoothing tool within the same heating period of time. In this way, heating can be conducted efficiently without hurting the scalp of the user. The heater material 200, for example, may be selected from ceramic, copper, aluminum, titanium, foil, iron, steel, carbon fiber, fiber glass, ceramic, clay, magnesium and metallic materials. The materials applicable in a reflective foil technology, such as heat-reflective aluminum film coated fiber glass fabric or cloth, a ceramic fiber paper, PTFE (Polytetrafluoroethylene) rope with graphite coating, weld backing tape, etc., may also be used in the present invention as the heater material 200.

If necessary, the above embodiments of hair combs and/or hair brushes can be used in combination with each other or in combination with other tools for specific purposes. For example, by connecting and properly configuring a paddle brush having the carpeting structure and another paddle brush with a heating function to form a composite brush and having hair relatively pass in between the paddle brushes, both smoothing and styling objectives can be achieved at the same time.

In the above embodiments, the carpeting structure 15 has a homogeneous configuration, e.g. either hook-structured or loop-structured. Alternatively, the carpeting structure 15 may also have a hybrid configuration, which is, for example, patched up with a hook-structured portion and a loop-structured portion.

Figure 12:
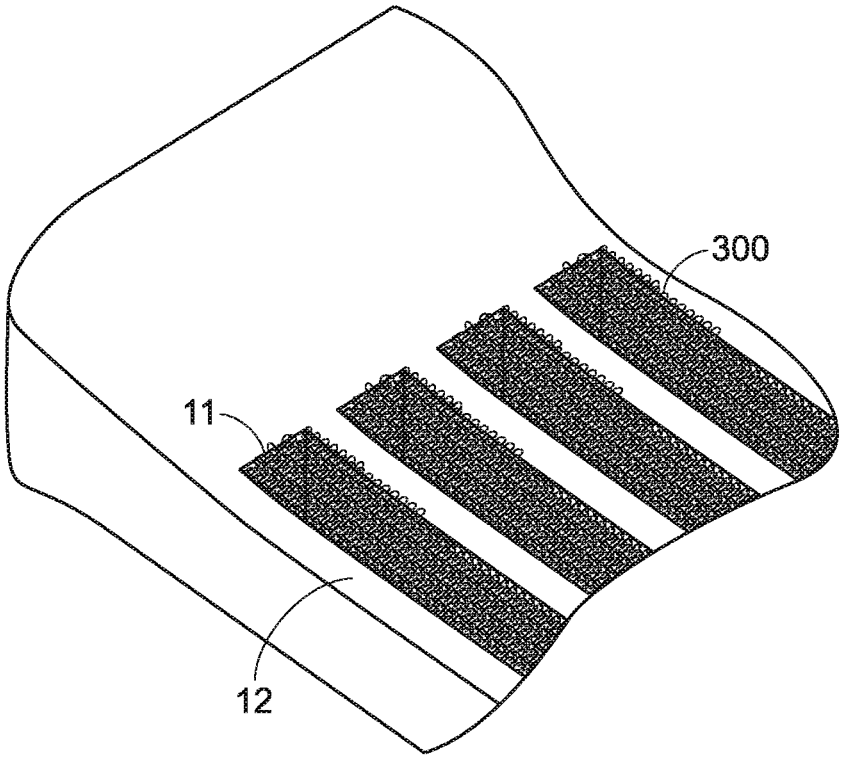
FIG. 12 is a schematic diagram illustrating a partially enlarged view of a hair-smoothing tool according to a still further embodiment of the present invention.

In the above embodiments, the carpeting structure partially or entirely overlies the supporting base or the cushion member of a hair brush or a hair comb. In further embodiments, the carpeting structure may also be alternatively or additionally provided onto the bristles or teeth of a hair brush or a hair comb. Take a hair comb with integrated supporting base and teeth as an example. As illustrated in FIG. 12, mini-posts 300 overlies not only the supporting base 11 but also the inner faces of the teeth 12, serving as the carpeting structure. Likewise, the mini-posts may be loop posts, hook posts, hybrid loop/hook posts, and/or any other suitable shape of posts, which are made of a soft material that would not hurt hair and scalp but rigid enough to detangle hair and smooth hair.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures. For example, it is to be noted that the term "bristles" recited in the appended claims indicates not only the projections from the supporting base of a hair brush, but also equivalently indicates the projections from the supporting base of a hair comb, which are commonly known as "teeth". For another example, the term "sticking out of" recited in the appended claims indicates not only "directly" protruding from but also "indirectly" protruding from, e.g. protruding from an overlying layer.

What is claimed is:

1. A hair-smoothing tool, comprising:

(i) a supporting base to be held by a user to move over hair; and (ii) a plurality of bristles or teeth protruding from the supporting base;

(iii) a carpeting structure at least partially overlying the supporting base, wherein the carpeting structure is comprised of a plurality of loop posts and hook posts, and wherein the plurality of loop posts and hook posts are generally perpendicular to the supporting base and of sufficient rigidity to penetrate hair when the supporting base moves over hair; and (iv) a second carpeting structure, wherein the second carpeting structure is attached to at least part of the bristles or teeth of the hair-smoothing tool, and wherein the second carpeting structure is comprised of a plurality of loop posts and/or hook posts.

2. A hair-smoothing tool, comprising:

(i) a supporting base to be held by a user to move over hair;

(ii) a cushion member attached to the supporting base;

(iii) a plurality of bristles or teeth protruding from the supporting base and through the cushion member;

(iv) a carpeting structure at least partially overlying the cushion member, wherein the carpeting structure is comprised of a plurality of loop posts and hook posts, and wherein the plurality of loop posts and hook posts are generally perpendicular to the supporting base and of sufficient rigidity to penetrate hair when the supporting base moves over hair; and (v) a second carpeting structure, wherein the second carpeting structure is attached to at least part of the bristles or teeth of the hair-smoothing tool, and wherein the second carpeting structure is comprised of a plurality of loop posts and/or hook posts.

* * * * *